US009728876B1

(12) United States Patent
Shiue et al.

(10) Patent No.: US 9,728,876 B1
(45) Date of Patent: Aug. 8, 2017

(54) ELECTRIC CONNECTOR

(71) Applicant: CEN LINK CO., LTD., Taipei (TW)

(72) Inventors: Gwo-Bin Shiue, Taipei (TW); Hsiu-Hui Liu, Taipei (TW)

(73) Assignee: CEN LINK CO., LTD., Taipei (TW)

( * ) Notice: Subject to any disclaimer, the term of this patent is extended or adjusted under 35 U.S.C. 154(b) by 0 days.

(21) Appl. No.: 15/343,797

(22) Filed: Nov. 4, 2016

(51) Int. Cl.

| | |
|---|---|
| ***H01R 12/00*** | (2006.01) |
| ***H01R 12/72*** | (2011.01) |
| ***H01R 24/64*** | (2011.01) |
| ***H01R 13/50*** | (2006.01) |
| ***H01R 13/405*** | (2006.01) |
| *H01R 107/00* | (2006.01) |

(52) U.S. Cl.
CPC ..... *H01R 12/725* (2013.01); *H01R 13/405* (2013.01); *H01R 13/50* (2013.01); *H01R 24/64* (2013.01); *H01R 2107/00* (2013.01)

(58) Field of Classification Search
CPC .... H01R 2107/00; H01R 24/64; H01R 13/50; H01R 13/405; H01R 12/725
USPC ..... 439/79, 629, 59, 660
See application file for complete search history.

(56) References Cited

U.S. PATENT DOCUMENTS 5,276,817 A * 1/1994 Matschke ..... H01R 12/79 361/679.4
5,709,555 A * 1/1998 Noschese ..... H01R 12/716 29/830
6,354,848 B1 * 3/2002 Billman ..... H01R 23/70 439/596
7,510,406 B2 * 3/2009 Dong ..... H01R 12/7011 439/79
7,651,343 B2 * 1/2010 Zhu ..... H01R 12/7047 439/569
7,670,151 B2 * 3/2010 Yang ..... H01R 12/7052 439/378
7,866,989 B1 * 1/2011 Zhu ..... H01R 12/57 439/79
7,878,816 B2 * 2/2011 Zhu ..... H01R 12/725 439/65
7,914,302 B1 * 3/2011 Zhu ..... H01R 13/41 439/79
(Continued)

*Primary Examiner* — Abdullah Riyami
*Assistant Examiner* — Nelson R Burgos-Guntin
(74) *Attorney, Agent, or Firm* — Muncy, Geissler, Olds & Lowe, P.C.

(57) ABSTRACT

An electric connector includes terminal holder including mating-connection space surrounded by holder base and two arms, insert-receiving portion defined at bottom side of holder base, mating-connection plate extended from the holder base and suspended in the mating-connection space and conducting terminals mounted in the mating-connection plate, and circuit board including plug portion inserted through the insert-receiving portion into the mating-connection space of terminal holder, two openings coupled to the arms of terminal holder, upper and lower metal terminals mounted on opposing top and bottom sides of plug portion, planar portion abutted to the bottom surface of mating-connection plate and a plurality of contacts arranged at the back side of the planar portion for the bonding of conducting terminals. Thus, the electric connector has advantages of low profile and low manufacturing cost and is practical for use in a mobile electronic device having light, thin, short and small characteristics.

10 Claims, 7 Drawing Sheets

(56) References Cited

U.S. PATENT DOCUMENTS

| | | | | |
|---|---|---|---|---|
| 7,963,800 | B1 * | 6/2011 | Chen | H01R 12/7047 439/607.27 |
| 8,007,289 | B2 * | 8/2011 | Bandhu | H01R 13/6271 439/638 |
| 8,011,966 | B1 * | 9/2011 | Tang | H01R 13/6461 439/638 |
| 8,162,680 | B2 * | 4/2012 | Zhu | H01R 12/727 439/79 |
| 8,308,515 | B2 * | 11/2012 | Chang | H01R 12/73 439/660 |
| 8,371,861 | B1 * | 2/2013 | Cina | H01R 12/721 257/215 |
| 8,382,491 | B2 * | 2/2013 | Chen | H01R 12/725 439/660 |
| 8,690,589 | B2 * | 4/2014 | Ngo | H01R 12/7052 439/630 |
| 8,926,341 | B2 * | 1/2015 | Chen | H01R 12/7088 439/79 |
| 2005/0032433 | A1 * | 2/2005 | Lee | H01R 12/585 439/660 |
| 2008/0188136 | A1 * | 8/2008 | Su | H01R 27/02 439/660 |
| 2010/0099307 | A1 * | 4/2010 | Zhang | H01R 13/64 439/660 |
| 2014/0057465 | A1 * | 2/2014 | Chang | H01R 12/62 439/79 |
| 2014/0206208 | A1 * | 7/2014 | Qian | H01R 12/722 439/79 |

* cited by examiner

ELECTRIC CONNECTOR

BACKGROUND OF THE INVENTION

1. Field of the Invention

The present invention relates to electric connector technology and more particularly, to an electric connector having the advantages of low profile and low manufacturing cost, which comprises a terminal holder that comprises a holder base, two arms extended from two opposite ends of the holder base, a mating-connection space defined between the two arms and an insert-receiving portion defined in a bottom side of the holder base, and a circuit board that is mounted in the insert-receiving portion of the terminal holder and suspended in the mating-connection space.

2. Description of the Related Art

In the era of technological innovation and progress, the production and application of advanced products are closely related with electronic technology. There are more and more products processed to achieve perfection by means of electronic technology innovation and superb skills. So, there are many items in the living environment around use that cannot escape having a great concern with electronic technology. Thus, computer has become a product that every modern people must use. Either in work, life or entertainment, computer has become an indispensable product in our modern life.

Further, a computer can be made in the form of a desktop type or laptop (notebook) type. A desktop computer is a personal computer designed for use on a desk or table due to its size and power requirements. A laptop (notebook) computer is a portable personal computer having light, thin, short and small characteristics. Due to the limitation of the size, the internal space of a laptop (notebook) computer for electronic components is relatively limited. A laptop (notebook) computer must uses its limited internal space for accommodating a hard disk drive, a mainboard, connection interfaces, electric connectors and many other components for storing data and signal transmission between the hard disk drive and the mainboard.

With the development of electronic technology, the functional requirements set for electrical connector are critical. The bandwidth density of conventional electrical connectors has been gradually inadequate. It has become the consensus of electronic connector manufacturers to improve the bandwidth density and compatibility of electrical connectors. Small Form Factor Committee has released SFF-8639. The SFF-8639 connector is the latest connector design for interfacing a connection to a either a MultiLink SAS drive or a PCIe drive-both Hard drives and SSD drives. It can be incorporated onto a PC board "docking backplane" for multiple drives, or onto a single-drive "T-Card" adapters such as CS Electronics' ADP-4439, ADP-43V39, and the new 2.5" PCIe NVMe SSD Cable adapter kit—ADP-PCIe-43V39. The SFF-8639 U.2 connector has a total of 6 High-Speed signal paths, however both the SAS and PCIe specifications only ever use up to 4 lanes at any time, and has been viewed as the most potent connector because it already has industry support in the enterprise space and with the SSD 750 Intel brought the SFF-8639 connector to the client side. However, in order to meet the requirements for electronic products having light, thin, short and small characteristics, the internal space of the connector housing must be compared. Thus, conventional electrical connectors have to be reduced in size and thickness.

Therefore, how to find ways to solve the above-described problem and inconvenience is the direction of improvement the relevant industry needs to study.

SUMMARY OF THE INVENTION

The present invention has been accomplished under the circumstances in view. It is therefore the main object of the present invention to provide an electric connector, which has a low profile characteristic and requires less number of component parts, saving the material cost and making the product more competitive.

To achieve this and other objects of the present invention, an electric connector comprises a terminal holder and a circuit board. The terminal holder comprises a holder base, two arms respectively forwardly extended from two opposite ends of the holder base, a mating-connection space surrounded by the holder base and the two arms, an insert-receiving portion defined in a bottom side of the holder base, a mating-connection plate forwardly extended from a front wall of the holder base and suspending in the mating-connection space, a plurality of terminal grooves located in a top wall of the mating-connection plate, and a plurality of conducting terminals respectively mounted in the terminal groove. Each conducting terminal comprises a contact portion located at a front end thereof and positioned in one respective terminal groove in the mating-connection plate, and a bonding portion located at an opposite end thereof and extended out of a back side of the holder base. The circuit board comprises two openings cut through opposing top and bottom surfaces and a front edge thereof, a plug portion defined between the two openings and inserted through the insert-receiving portion into the mating-connection space of the terminal holder, a plurality of upper metal terminals and lower metal terminals respectively arranged on opposing top and bottom surfaces of the plug portion, a planar portion located on the top surface of the plug portion and abutted to a bottom surface of the mating-connection plate of the terminal holder, and a plurality of contacts arranged on the plug portion at a rear side relative to the planar portion for the bonding of the conducting terminals of the terminal holder. Because the circuit board is inserted through the insert-receiving portion and suspended in the mating-connection space of the terminal holder, mounting the circuit board in the terminal holder does not increase the overall height of the terminal holder, enabling the electric connector to obtain a low profile characteristic.

Further, the lugs of the plug-in components are bonded to the respective solder joints of the circuit board with a solder paste. The design of the notches of the lugs increases the bonding surface area and prevents solder overflow, enhancing the bonding shear strength.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
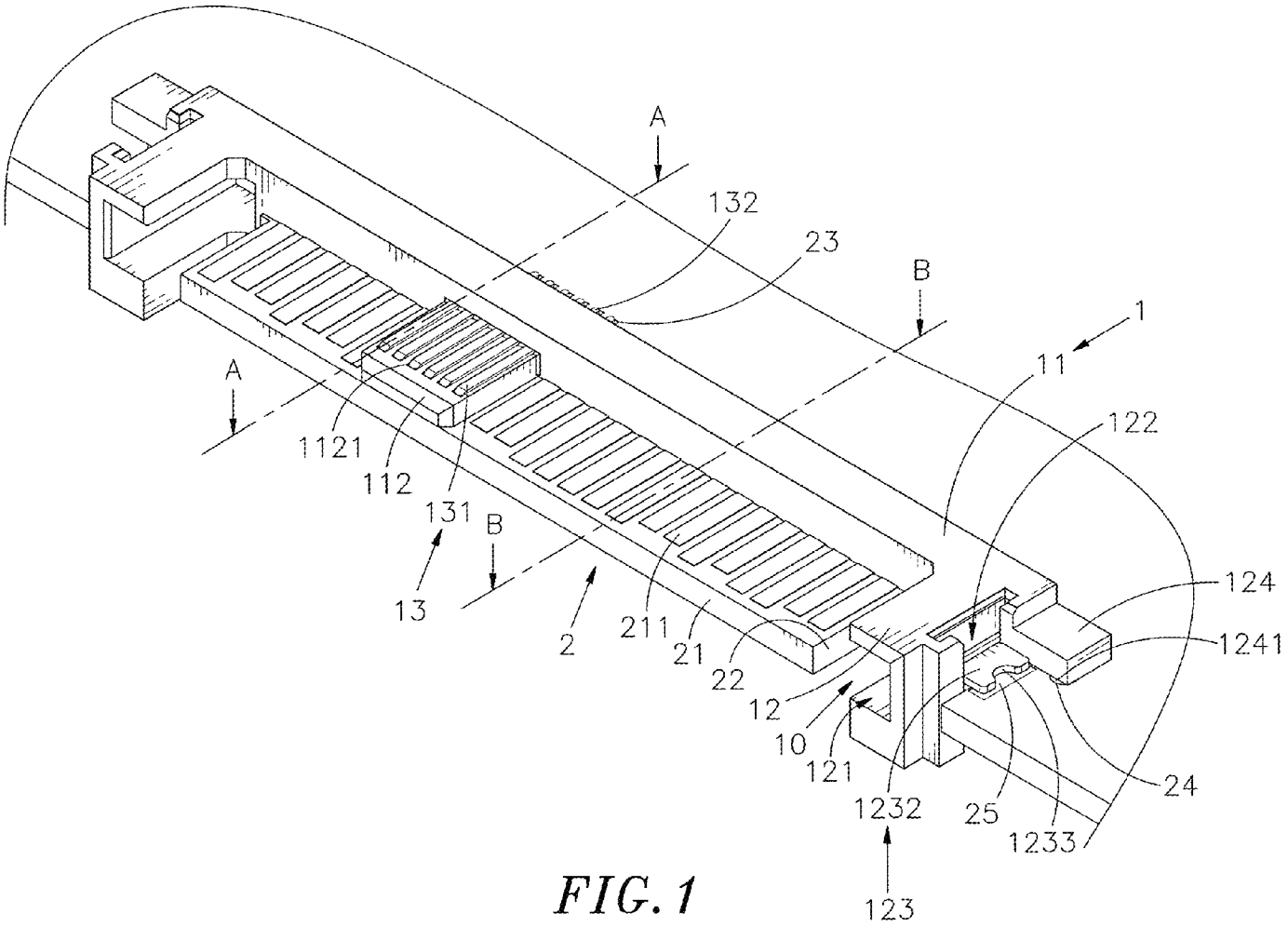
FIG. 1 is an oblique top elevational view of an electric connector in accordance with a first embodiment of the present invention.
Figure 2:
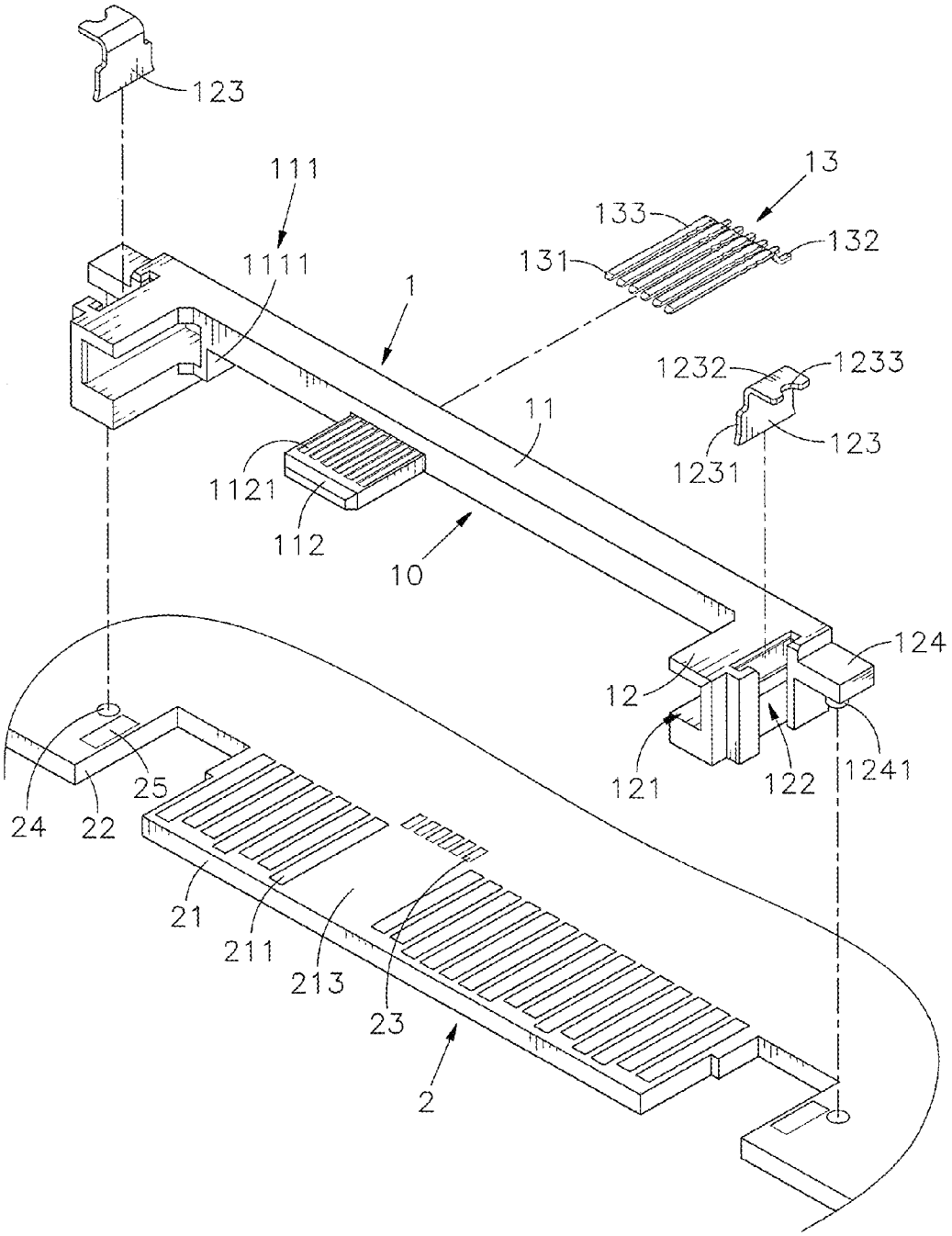
FIG. 2 is an exploded view of the electric connector in accordance with the first embodiment of the present invention.
Figure 3:
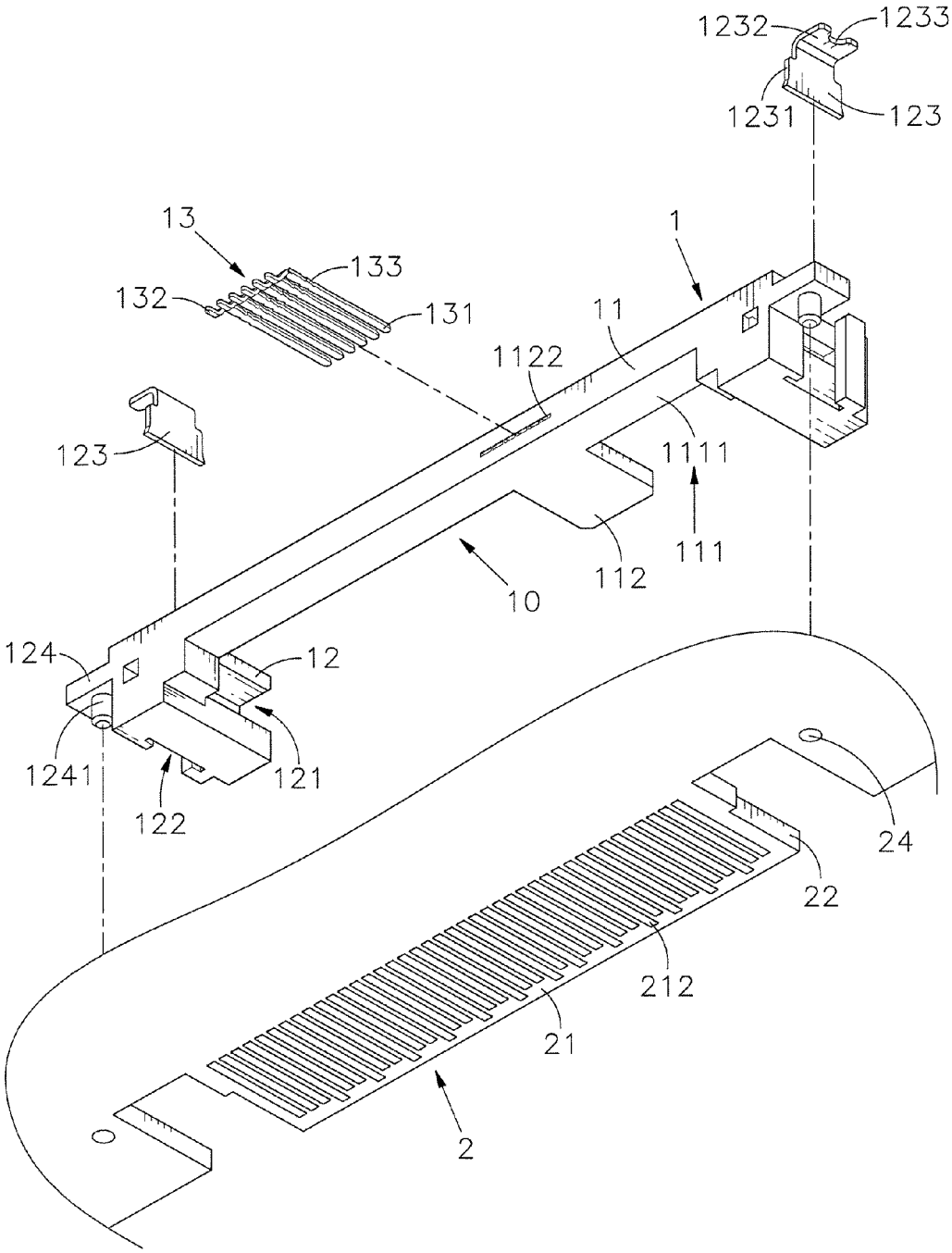
FIG. 3 corresponds to FIG. 2 when viewed from another angle.
Figure 4:
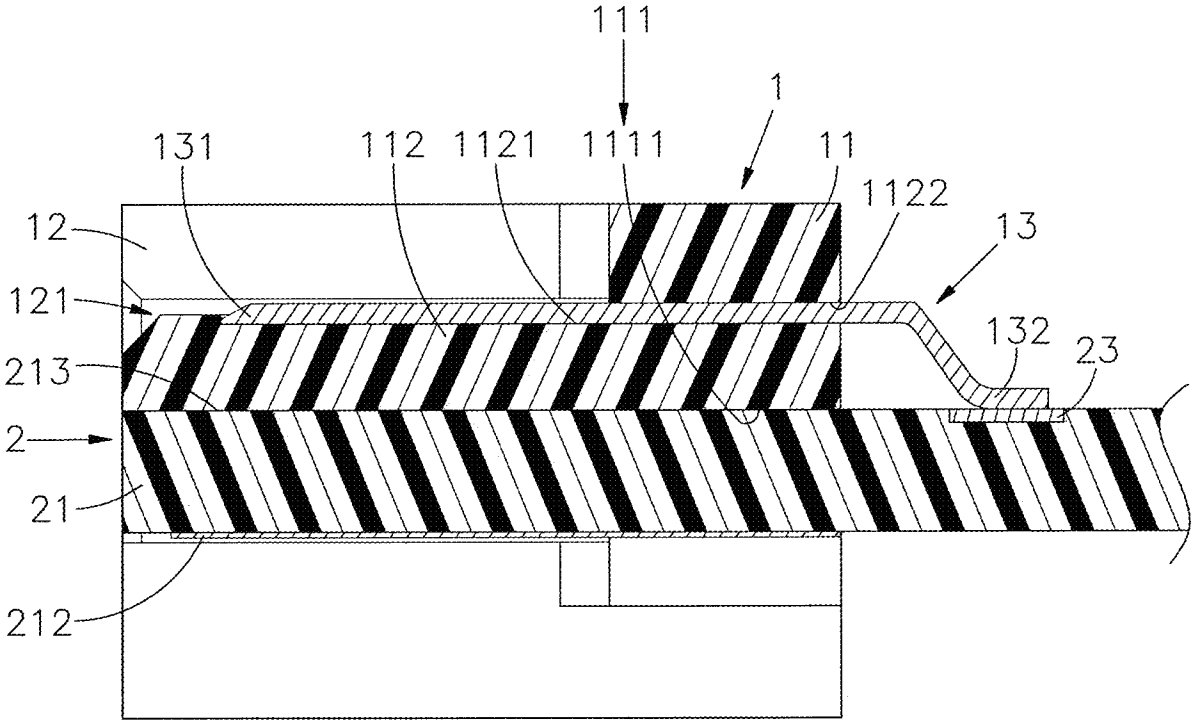
FIG. 4 is a sectional view taken along line A-A of FIG. 1.
Figure 5:
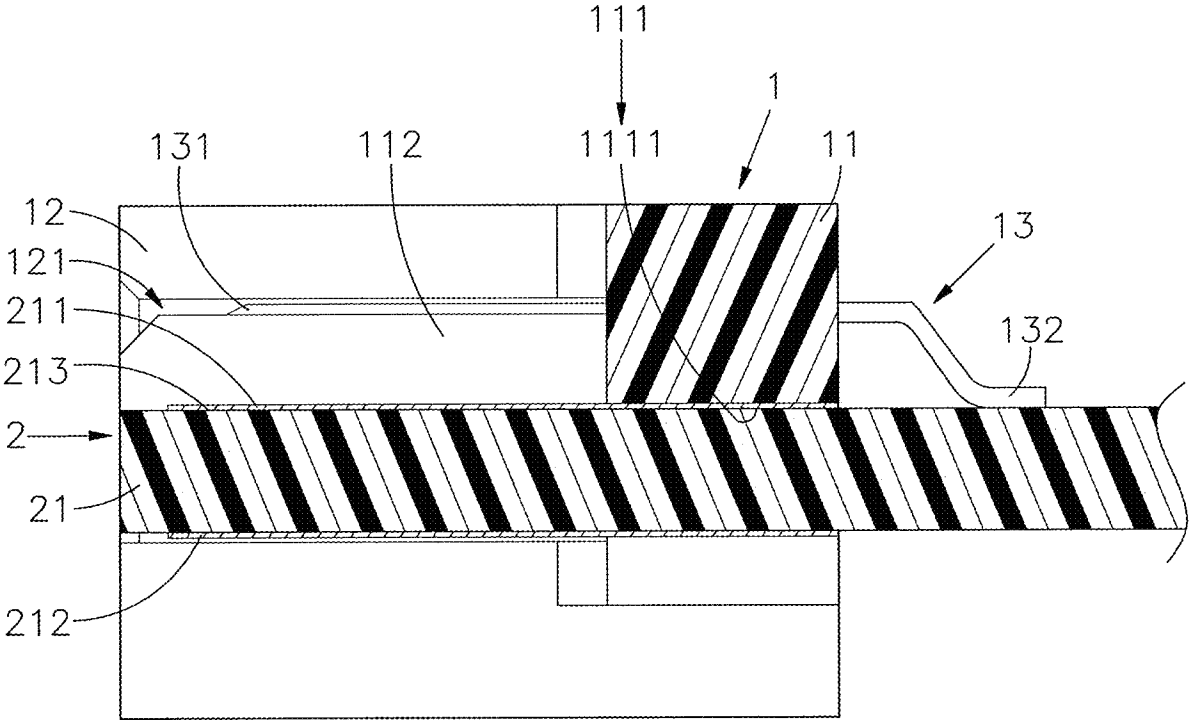
FIG. 5 is a sectional view taken along line B-B of FIG. 1.

Referring to FIGS. 1-5, an elevational view of an electric connector in accordance with a first embodiment of the present invention, an oblique top exploded view of the electric connector in accordance with the first embodiment of the present invention, an oblique bottom exploded view of the electric connector in accordance with the first embodiment of the present invention, a sectional view taken along line A-A of FIG. 1 and a sectional view taken along line B-B of FIG. 1 are shown. As illustrated, the electric connector comprises a terminal holder 1 and a circuit board 2.

The terminal holder 1 comprises a holder base 11, two arms 12 respectively forwardly extended from two opposite ends of the holder base 11, a mating-connection space 10 surrounded by the holder base 11 and the two arms 12, an insert-receiving portion 111 defining a receiving groove 1111 in a bottom side of the holder base 11, a mating-connection plate 112 forwardly extended from a front wall of the holder base 11 and suspending in the mating-connection space 10, a plurality of terminal grooves 1121 located in a top wall of the mating-connection plate 112, a plurality of terminal slots 1122 cut through the opposing front and back walls of the holder base 11 and respectively disposed in communication with the respective terminal grooves 1121, a plurality of conducting terminals 13 respectively mounted in the terminal groove 1121 of the mating-connection plate 112, a position-limiting groove 121 horizontally defined in the each arm 12 at an inner side in communication with the mating-connection space 10, an insertion groove 122 vertically defined in the each arm 12 at an opposing outer side, a plug-in component 123 mounted in the each insertion groove 122, an end block 124 outwardly extended from the each arm 12 adjacent to the associating the insertion groove 122, and a locating pin 1241 vertically downwardly extended from a bottom wall of the each end block 124. Further, the each conducting terminal 13 comprises a contact portion 131 located at one end thereof and positioned in one respective the terminal groove 1121 of the mating-connection plate 112 inside the mating-connection space 10, an opposing bonding portion 132 located at an opposite end thereof and extended out of the back wall of the holder base 11 through one respective the terminal slot 1122, and barbed engagement portions 133 protruded from two opposite lateral sides thereof between the contact portion 131 and the bonding portion 132 and forced into friction engagement with the peripheral wall of the respective terminal slot 1122. Further, the each plug-in component 123 comprises a plug-in portion 1231 engaged into one respective the insertion groove 122, a lug 1232 extended from a top side of the plug-in component 123 at right angle and suspending outside the respective insertion groove 122, and a notch 1233 located at an outer edge of the lug 1232.

The circuit board 2 comprises two openings 22 cut through opposing top and bottom surfaces and a front edge thereof and defining a plug portion 21 between the two openings 22, a plurality of upper metal terminals 211 and lower metal terminals 212 respectively arranged on opposing top and bottom surfaces of the plug portion 21, a planar portion 213 located on the top surface of the plug portion 21 between the upper metal terminals 211, a plurality of contacts 23 arranged on the top wall of the plug portion 21 at a rear side of the planar portion 213, two mounting holes 24 cut through opposing top and bottom walls of the circuit board 2 at two opposite lateral sides relative to the opening 22, and two solder joints 25 located on the top wall of the circuit board 2 and respectively disposed between the mounting holes 24 and the openings 22.

When assembling the electric connector, downwardly attach the terminal holder 1 to the circuit board 2 to force the receiving groove 1111 of the insert-receiving portion 111 into abutment against the top surface of the plug portion 21 of the circuit board 2 and to insert the arms 12 and the locating pins 1241 of the terminal holder 1 into the respective openings 22 and the mounting holes 24 of the circuit board 2, enabling the plug portion 21 of the circuit board 2 to be suspended in the mating-connection space 10 of the terminal holder 1 and the end blocks 124 to be stopped at the top surface of the circuit board 2. At this time, the planar portion 213 of the plug portion 21 is abutted to the bottom surface of the mating-connection plate 112 of the holder base 11 and the lugs 1232 of the two plug-in components 123 are respectively attached to the two solder joints 25 of the circuit board 2. Thereafter, use a proper soldering technique to bond the bonding portions 132 of the conducting terminals 13 and the lugs 1232 of the plug-in components 123 to the respective contacts 23 and the solder joints 25 of the circuit board 2, positively and electrically connecting the terminal holder 1 to the circuit board 2 to complete the assembly process.

The terminal holder 1 and the circuit board 2 of the electric connector are configured subject to SFF-8639 specifications, i.e., the electric connector of the present invention is a SFF-8639 female connector for the connection of a SFF-8639 male connector for data transmission.

Figure 6:
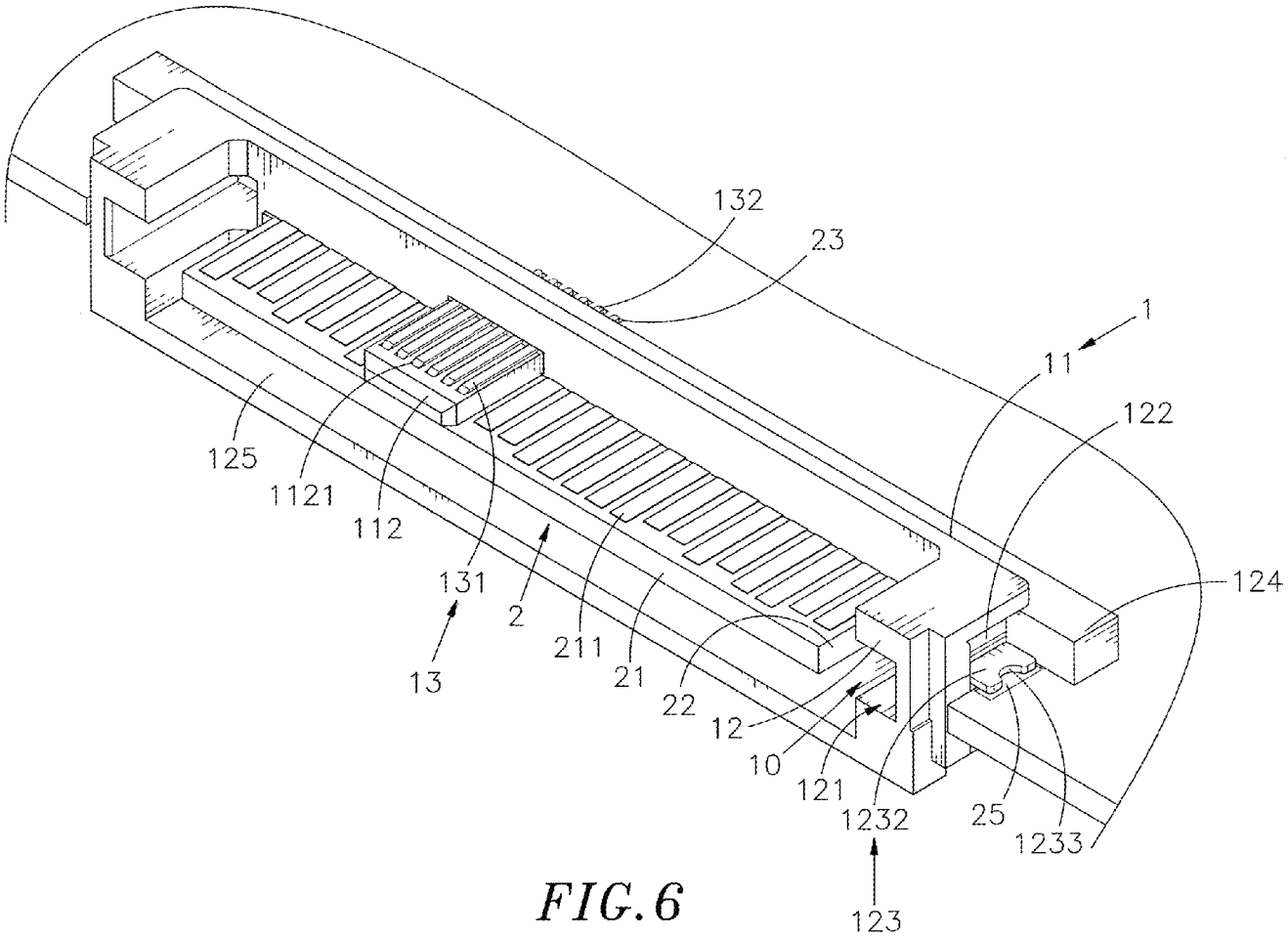
FIG. 6 is an oblique top elevational view of an electric connector in accordance with a second embodiment of the present invention.
Figure 7:
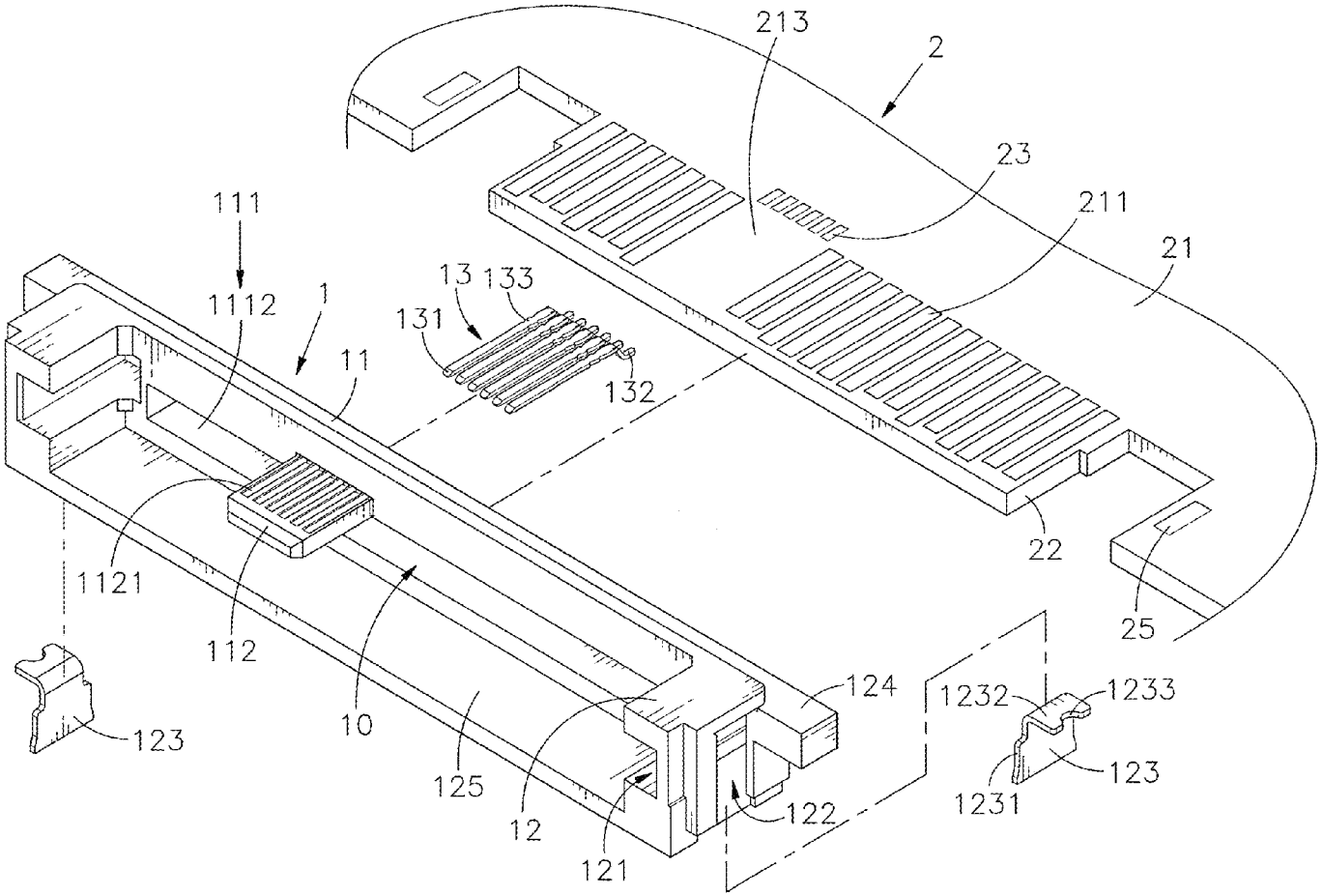
FIG. 7 is an exploded view of the electric connector in accordance with the second embodiment of the present invention.

Referring to FIGS. 6 and 7, an oblique top elevational view of an electric connector in accordance with a second embodiment of the present invention and an exploded view of the electric connector in accordance with the second embodiment of the present invention are shown. This second embodiment is substantially similar to the aforesaid first embodiment with the exceptions outlined hereinafter. According to this second embodiment, the insert-receiving portion 111 of the terminal holder 1 defines an insertion slot 1112 that extends through the opposing front and back sides of the holder base 11; the terminal holder 1 further comprises a bottom supporting panel 125 connected between respective bottom sides of the two arms 12; the locating pins 1241 located at the respective bottom sides of the respective end blocks 124 as shown in the aforesaid first embodiment are eliminated in this second embodiment. When assembling the terminal holder 1 and the circuit board 2, attach the terminal holder 1 to the circuit board 2 in a front-to-back direction, enabling the plug portion 21 of the circuit board 2 to insert through the insertion slot 1112 of the insert-receiving portion 111 into the mating-connection space 10 and the two arms 12 of the terminal holder 1 to be positioned in the respective openings 22 of the circuit board 2. Thereafter, bond the bonding portions 132 of the conducting terminals 13 and the lugs 1232 of the plug-in components 123 to the respective contacts 23 and the solder joints 25 of the circuit board 2. Thus, the assembly process of this second embodiment is completed. When the electric connector (female connector) of this second embodiment receives an external mating electric connector (male connector; not shown), the bottom supporting panel 125 provides enhanced support.

As stated above, in the second embodiment of the present invention, the plug portion 21 of the circuit board 2 is inserted through the insert-receiving portion 111 of the terminal holder 1 into the mating-connection space 10, the conducting terminals 13 are positioned in the mating-connection plate 112 of the holder base 11 and electrically bonded to the respective contacts 23 that are arranged on the top surface of the circuit board 2. Thus, the overall height of the electric connector is significantly reduced, i.e., the electric connector of the present invention has a low profile characteristic practical for use in a mobile electronic device that has light, thin, short and small characteristics. When compared with the conventional electrical connectors, the invention requires less number of component parts, saving the material cost and making the product more competitive.

Further, the lugs 1232 of the plug-in components 123 are bonded to the respective solder joints 25 of the circuit board 2 with a solder paste. The design of the notches 1233 of the lugs 1232 increases the bonding surface area and prevents solder overflow, enhancing the bonding shear strength.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An electric connector, comprising:

a terminal holder comprising a holder base, two arms respectively forwardly extended from two opposite ends of said holder base, a mating-connection space surrounded by said holder base and said two arms, an insert-receiving portion defined in a bottom side of said holder base, a mating-connection plate forwardly extended from a front wall of said holder base and suspending in said mating-connection space, a plurality of terminal grooves located in a top wall of said mating-connection plate, and a plurality of conducting terminals respectively mounted in said terminal groove, each said conducting terminal comprising a contact portion located at a front end thereof and positioned in one respective said terminal groove in said mating-connection plate and a bonding portion located at an opposite end thereof and extended out of a back side of said holder base; and a circuit board comprising two openings cut through opposing top and bottom surfaces and a front edge thereof, a plug portion defined between said two openings and inserted through said insert-receiving portion into said mating-connection space of said terminal holder, a plurality of upper metal terminals and lower metal terminals respectively arranged on opposing top and bottom surfaces of said plug portion, a planar portion located on the top surface of said plug portion and abutted to a bottom surface of said mating-connection plate of said terminal holder, and a plurality of contacts arranged on said plug portion at a rear side relative to said planar portion.

2. The electric connector as claimed in claim 1, wherein said insert-receiving portion defines a receiving groove in a bottom side of said holder base for receiving said plug portion of said terminal holder.

3. The electric connector as claimed in claim 1, wherein said insert-receiving portion defines an insertion slot for the insertion of said plug portion of said circuit board.

4. The electric connector as claimed in claim 1, wherein said terminal holder further comprises a plurality of terminal grooves located on said mating-connection plate for the positioning of the said contact portions of the respective said conducting terminals, and a plurality of terminal slots cut through opposing front and back walls of said holder base and respectively disposed in communication with the respective said terminal grooves for the passing of the respective said conducting terminals.

5. The electric connector as claimed in claim 1, wherein said terminal holder further comprises a bottom supporting panel connected between said two arms.

6. The electric connector as claimed in claim 1, wherein said terminal holder further comprises a position-limiting groove horizontally defined in each said arm at an inner side in communication with said mating-connection space.

7. The electric connector as claimed in claim 1, wherein said terminal holder further comprises an insertion groove vertically defined in each said arm at an outer side, and a metal plug-in component mounted in each said insertion groove.

8. The electric connector as claimed in claim 7, wherein said terminal holder further comprises said plug-in component mounted in each said insertion groove, each plug-in portion comprising a lug extended from a top side thereof at right angles and suspended outside the associating said insertion groove, and a notch located at an outer edge of said lug; a circuit board further comprises two solder joints respectively disposed between mounting holes and openings for the bonding of the said two lugs of the said two plug-in components of said terminal holder.

9. The electric connector as claimed in claim 1, wherein said circuit board further comprises two mounting holes cut through the opposing top and bottom surfaces thereof at two opposite lateral sides relative to the two said openings; said terminal holder further comprises an end block outwardly extended from each said arm, and a locating pin vertically downwardly extended from a bottom wall of each said end block and plugged into one respective said mounting hole of said circuit board.

10. The electric connector as claimed in claim 1, wherein each said conducting terminal of said terminal holder further comprises a plurality of barbed engagement portions located at two opposite lateral sides thereof between the associated said contact portion and said bonding portion.

* * * * *